United States Patent [19]

Klowak

[11] 4,448,638

[45] May 15, 1984

[54] PAPER WEBS HAVING HIGH BULK AND ABSORBENCY AND PROCESS AND APPARATUS FOR PRODUCING THE SAME

[75] Inventor: Bernard G. Klowak, Neenah, Wis.

[73] Assignee: James River-Dixie/Northern, Inc., Norwalk, Conn.

[21] Appl. No.: 426,973

[22] Filed: Sep. 29, 1982

Related U.S. Application Data

[63] Continuation of Ser. No. 182,835, Aug. 29, 1980, abandoned.

[51] Int. Cl.[3] ..... D21H 5/24

[52] U.S. Cl. ..... 162/112; 162/158

[58] Field of Search ..... 162/111, 112, 113, 134, 162/135, 136, 137, 158, 168.1, 164.1, 174; 156/183; 264/283; 427/264, 275, 288

[56] References Cited

U.S. PATENT DOCUMENTS

| | | | |
|---|---|---|---|
| 2,432,126 | 12/1947 | Schlosser et al. | 162/158 |
| 2,432,127 | 12/1947 | Schlosser et al. | 162/158 |
| 2,610,935 | 9/1952 | Rowe | 156/183 |
| 3,163,575 | 12/1964 | Nobbe | 162/111 |
| 3,301,746 | 1/1967 | Sanford et al. | 162/113 |
| 3,395,708 | 8/1968 | Hervey et al. | 128/284 |
| 3,546,065 | 12/1970 | Ostermeier | 162/111 |
| 3,687,754 | 8/1972 | Stumpf | 156/72 |
| 3,812,000 | 5/1974 | Salvucci | 162/111 |
| 3,821,068 | 6/1974 | Shaw | 162/111 |
| 3,822,162 | 7/1974 | Stumpf | 156/72 |
| 4,000,237 | 12/1976 | Roberts | 264/283 |
| 4,063,995 | 12/1977 | Grossman | 162/112 |
| 4,064,213 | 12/1977 | Lazorisak et al. | 162/112 |
| 4,125,659 | 11/1978 | Klowak et al. | 162/112 |
| 4,158,594 | 6/1979 | Becker et al. | 162/111 |

FOREIGN PATENT DOCUMENTS 1294794 11/1972 United Kingdom .

OTHER PUBLICATIONS

"High Bulk—The Latest Trend in Tissue", Pulp and Paper, Jan. 1978, pp. 52–56.

*Primary Examiner*—Peter Chin

*Attorney, Agent, or Firm*—Isaksen, Lathrop, Esch, Hart & Clark

[57] ABSTRACT

Paper webs are produced in a modified conventional felted wet press process in which the fiber furnish has a chemical debonding agent added thereto in high concentrations. The web (17) is formed on a conventional Fourdrinier wire (12), transferred to a moving felt (19) which presses the web against the surface of a drying cylinder (23) to reduce its water content, and is carried by the surface of the drying cylinder (23) to a creping blade (24). Liquid adhesive is applied to the surface of the creping cylinder (23) adhead of the contact with the web to provide substantial adherence of the web to the creping surface at the point of contact with the creping blade. The levels of addition of debonding agent to the pulp furnish and the amount of adhesive applied to the creping surface are selected such that the adhesion of the web to the surface at the creping blade is greater than the internal cohesion of the web. Under these conditions, a highly bulked and internally delaminated web is produced which has bulk and absorbency superior to products ordinarily produced in the conventional wet press process. The bulk and absorbency of the finished web may be further enhanced by utilizing a reverse angle creping blade (24) which meets the surface of the creping cylinder (23) at a cutting angle not more than 72° and preferably between 52° and 64°. The reverse angle blade causes the fibers in the web to reverse direction at the line of contact with the creping blade and therefore enhances the disruption of fiber bonds to increase bulkiness.

11 Claims, 6 Drawing Figures

PAPER WEBS HAVING HIGH BULK AND ABSORBENCY AND PROCESS AND APPARATUS FOR PRODUCING THE SAME

This is a continuation of application Ser. No. 182,835, filed Aug. 29, 1980 now abandoned.

TECHNICAL FIELD

This invention pertains to the field of paper making processes and apparatus and to conventional wet press paper making procedures and the products produced thereby.

BACKGROUND ART

It is highly desirable that paper toweling and personal care tissue-type products have a consumer perceived feel of softness, which is related to the product's bulk and density, and that the product be capable of readily absorbing liquids. These characteristics are related to the strength of the interfiber bonds within the paper web which occur as a result of the paper making process.

In the conventional felted wet press paper forming process, a liquid slurry of pulp, water and other chemicals is typically deposited on a Fourdrinier forming wire, transferred to a felt or fabric belt for drying and pressing, and thence transferred to a rotating Yankee drier cylinder which is heated to cause the paper to substantially dry on the cylinder surface. The moisture within the web as it is laid on the Yankee surface causes the web to adhere to the surface, and, in the production of tissue and toweling type non-woven products, the web is typically creped from the dryer surface with a creping blade. The creped web is then usually passed between calender rollers and rolled up prior to further converting operations. The action of the creping blade on the paper is known to cause a portion of the interfiber bonds within the paper to be broken up by the mechanical smashing action of the blade against the web as it is being driven into the blade. However, fairly strong interfiber bonds are formed between the wood pulp fibers during the drying of the moisture from the web. The strength of these bonds is such that, even after conventional creping, the web retains a perceived feeling of hardness, a fairly high density, and low bulk and water absorbency.

To reduce the strength of the interfiber bonds inevitably formed when wet pressing and drying the web from a slurry, various processes have been utilized. One such process is the passing of heated air through the web fibrous web after it is formed on a wire and transferred to a pervious carrier—a so called through-air-dried process—so that the web is not compacted prior to being dried. The lack of compaction, such as would occur when the web is pressed while on the felt and against the drying cylinder when it is transferred thereto, reduces the opportunity for interfiber bonding to occur, and allows the finished product to have greater bulk than can be achieved in the conventional wet press process. Generally, the tensile strength of webs formed in the through-air-dried process is not adequate for a finished consumer product, and various types of bonders are typically introduced into the web in subsequent operations to acheive the desired strength while still retaining most of the bulk of the original product. Further reduction in the internal cohesion of the paper product may be obtained using various dry forming processes, such as air laying of substantially dry fibers onto a forming wire such that the resulting web has extremely low internal cohesion and very great bulk. Virtually all of the strength of such webs is obtained from the binders that are added to the web after forming. Because of the consumer perceived softness of these products, and their greater ability to absorb liquids than webs formed in conventional wet press processes, the products formed by the newer processes enjoy an advantage in consumer acceptance.

The conventional felted wet process is significantly more energy efficient than processes such as through-air-drying and air laying of webs since it does not require the heating and moving of large quantities of air, as does the through-air-dried process, and does not require complete drying and fiberizing of the webs as in the dry formed air laid processes. Excess moisture is mechanically pressed from the web and the final drying of the web is obtained chiefly on the heated Yankee drying cylinder which is maintained at the proper drying temperature with a relatively small expenditure of energy.

Some increase in the bulk of webs formed in the conventional wet press process has been obtained by utilizing chemical debonding agents which are added to the pulp furnish to inhibit the formation of the interfiber bonds. However, the use of chemical debonders in the furnish has not been observed to increase the bulk and absorbency of webs formed therefrom to the levels achieved in through-air-drying and air laying processes.

DISCLOSURE OF THE INVENTION

Paper webs are produced in accordance with the invention in a modified conventional felted wet press process and have exceptional bulk and absorbency—comparable to such qualities measured in webs formed in through-air-drying processes. Conventional paper making equipment can be utilized with inexpensive modifications which do not affect the energy efficiency of the conventional wet press process.

In accordance with the present invention, the conventional wet press process is modified so that the adhesion of the formed web to the surface of the dryer cylinder at the point of contact with the creping blade is greater than the internal cohesion of the web. It has been discovered that is the foregoing condition is substantially satisfied, the bulk, water absorbency, oil holding capacity and caliper of the resulting product are substantially improved over that obtainable in products formed by conventional processes which do not approach this condition. The relatively low internal cohesion of the web under such conditions also allows the use of a "reverse angle" creping blade which produces a vigorous mechanical fracture of the fiber bonds at the line of contact of the web with the creping blade, and results in even greater bulk in the completed product.

In the process of the invention, a chemical debonding agent is mixed into the aqueous pulp furnish at significant concentration levels to minimize the later formation of hydrogen bonds between fibers after they are laid. The debonder and slurry mixture is then formed into a web on a forming or Fourdrinier wire and partially dried on it. The web is transferred to a belt of fabric or felt, is pressed to remove excess water, and is then transferred to the polished and heated surface of a creping cylinder. The surface has a uniform coating of creping adhesive applied to it before contact with the web in amounts sufficient to result in adhesion at the creping blade between the dried web and the creping surface which is greater than the internal cohesion of the web itself. The bulk, oil absorbency and water absorbency of the resulting product can be further improved by utilizing a reverse angle creping blade—that is, a blade which meets the creping surface at an angle such that the web is forced to turn sharply back upon itself at the line of contact with the creping blade. The preferred creping or cutting angle—the angle between a tangent to the creping surface and the face of the creping blade which meets the web—will preferably be between 52° and 64°. The reduction of the internal cohesion of the web achieved by the use of high concentrations of chemical debonder allows such a reverse angle blade to be utilized, since in products produced without chemical debonder the cohesion and strength of the web is usually so great that a reverse angle blade cannot be used.

The paper product produced in accordance with the invention can be formed from a variety of pulp furnishes such as standard softwood kraft. The resulting finished web product is characterized by having a basis weight from 10 to 40 pounds per ream (3,000 sq. ft.), a preferred weight of approximately 15 pounds per ream (3,000 sq. ft.), an oil holding capacity of at least about 8 milliliters per gram of product, a caliper for 8 plys between 1.18 and 1.37 millimeters under a compressive pressure of 26.6 grams/square centimeter, a machine direction tensile strength of between 34 and 66 grams per centimeter, and a cross direction tensile strength between 12 and 19 grams per centimeter; with the bonding between fibers within the web consisting almost entirely of conventional fiber-to-fiber hydrogen bonding and substantially excluding additional bonding materials. Residual debonding agent is also mixed with the fibers in the web.

Further objects, features and advantages of the invention will be apparent from the following detailed description taken in conjunction with the accompanying drawings which show apparatus for producing high bulk and absorbency fibrous webs in accordance with the invention.

BEST MODE FOR CARRYING OUT THE INVENTION

Figure 1:
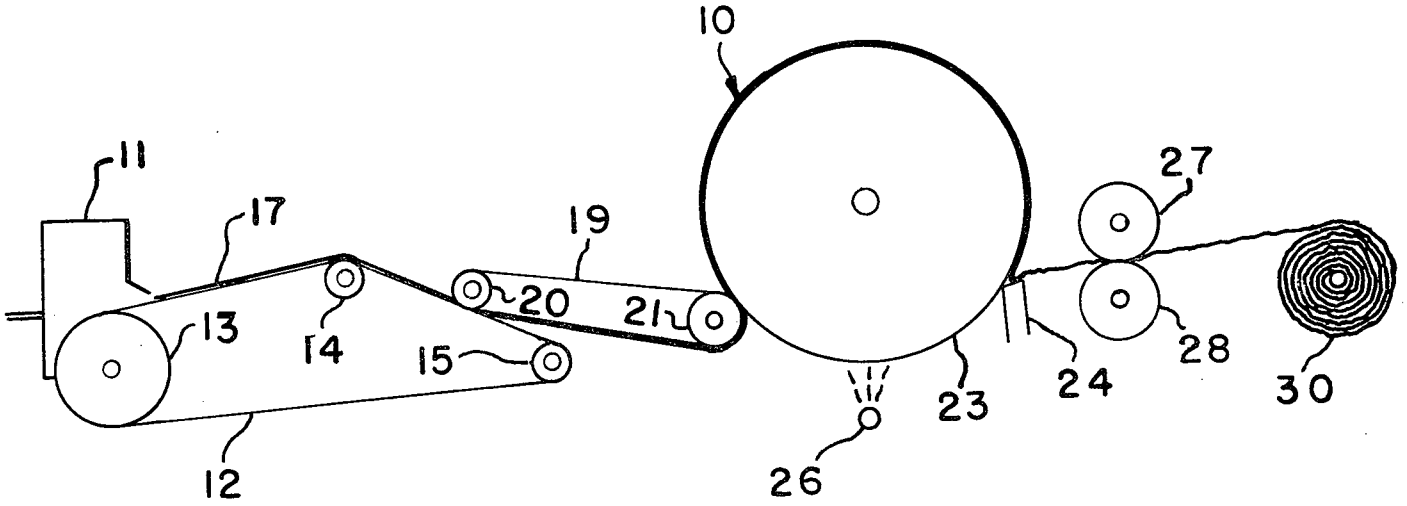
FIG. 1 is a simplified schematic view of an apparatus for producing a paper web in accordance with the invention.

With reference to the drawings, an apparatus for producing paper webs in accordance with the invention is shown generally at 10 in FIG. 1 in simplified schematic form. A pulp slurry furnish is mixed with a chemical debonding agent in a stock tank (not shown) and transferred to a headbox 11. The furnish is distributed from the headbox 11 onto a moving Fourdrinier wire 12 which is supported for movement by a breast roll 13 and return rolls 14 and 15.

Various chemical debonding agents, well known in the paper making art, can be mixed with the fiber furnish to inhibit the formation of bonds between the fibers after forming. One suitable debonding agent is a quaternized imidazoline, which has been found to provide satisfactory results when mixed into the pulp furnish at a level of at least 30 parts per million (ppm) by weight of the overall fiber furnish and at a level of at least 0.5% on the dry weight of the fiber, with the preferred range of addition of this debonding agent being between 30 ppm and 50 ppm (0.5% to 0.8% on dry fiber weight). This level of debonder has been observed to yield the desired reduction in internal cohesion of the formed web while not unduly interfering with the capability of the web to adhere to the drying cylinder surface. Since quaternized imidazoline serves as a lubricant as well as an inhibitor of interfiber bond formation, as do most chemical debonding agents, it has been observed that addition of this debonding agent above the ranges indicated does not result in significant product improvement because of the difficulty of properly adhering the web to the surface on which it is dried. Other debonding agents, e.g., other quaternary ammonium compounds and tertiary amine salts, may also be used in the process. If such other debonding agents are used, the level of addition of these agents can similarly be selected to provide the desired reduction in interfiber bonding without unduly reducing the adhesion of the web to the drying cylinder.

The formed, wet web 17, supported on the Fourdrinier wire 12, is pressed into contact with an endless belt of drying fabric or felt 19 which is supported by end rolls 20 and 21. The wet formed web 17 is further dried as it is transferred by the felt 19, which drying may be augmented by various expedients such as vacuum draw applied to the web, steam nozzles, pressing of the web on the felt to remove water, and so forth, which are of standard design in conventional felted wet press processes and are not shown in FIG. 1, although apparent to those skilled in the art. The partially dried web passes around the second end roll 21 into firm contact with the polished cylindrical surface of a heated Yankee drier cylinder 23. The Yankee drier 23 is internally heated in a conventional manner so that substantial drying of the web occurs as the web moves along with the drier surface toward contact with a creping blade 24. A spraying nozzle 26 is mounted near the bottom of the cylinder rotationally ahead of the area at which the web contacts the cylinder and sprays a uniform coating of liquid adhesive onto the surface of the drier. The adhesive utilized may be any type of water soluble or insoluble adhesive typically utilized in paper making, such as animal glue or various latex resins. As described in further detail below, the adhesive is sprayed on to a density which will allow the web 17 to achieve a degree of adhesion to the surface of the drier cylinder at the point where it meets the creping blade 24 which is greater than the internal cohesion of the web at this point. The creping blade 24 is preferably a reverse angle blade, as illustrated in FIG. 1, to enhance the bulking effect.

The creped web is optionally passed through a pair of calender rolls 27 and 28 which apply light contact pressure to the web, which is then wound up into a stock roll 30 to await further processing. The properties of the paper web of the invention are such that the strength of the product is generally not sufficient to allow it to be used without further processing in which tensile strength is added to the product by the introduction of bonding agents. While the use of such additional agents to achieve higher levels of strength is necessary for applications such as paper toweling, the product of the invention can be used directly in low stress-type applications such as bathroom and facial tissues.

The present process uses the conventional wet pressing of the web on the felt 19 at the nip between the end roller 21 and the Yankee drier surface to reduce the water content of the web prior to its final drying on the Yankee drier cylinder. The removal of water from the web by this mechanical means substitutes for the removal of water achieved by passing hot air through the wet web in the through-air-dried process. Heretofore, the great disadvantage of the conventional felted wet press process was the strengthening of the bonds between the fibers that takes place as a result of the pressing of the web to reduce its water content. While in prior processes the pressing inevitably resulted in a stronger, less bulky and less absorbent product, the present process substantially overcomes the bonding between fibers that occurs as a result of the wet press to achieve a final product which could not be produced by the conventional wet press process. This improvement is achieved in the present invention by providing process conditions such that the adhesion of the web to the Yankee drier surface at the intersection of the web with the creping blade will be greater than the internal cohesion of the web, with the result that the web tends to delaminate at the creping blade into outer layers of generally arranged fibers separated by inner layers of much more widely spaced and disarrayed fibers which have been mechanically debonded from one another.

Figure 2:
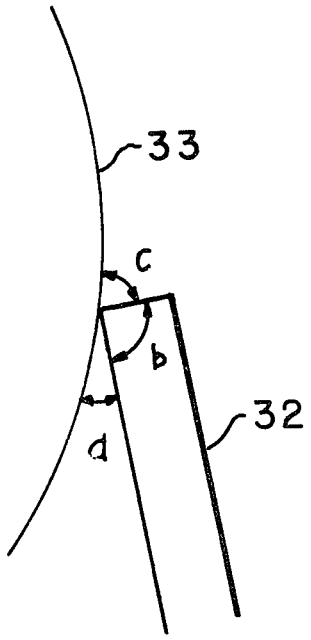
FIG. 2 is a view of a conventional creping blade meeting the surface of a creping cylinder and showing the creping angles involved.

Because the web as it dries on the Yankee drier cylinder 23 has very low internal cohesion, it has now been discovered that it is possible to further increase the bulk of the creped product by utilizing a "reverse angle" creping blade. For purposes of illustration, a conventional 90° creping blade 32 is shown in FIG. 2 mounted with its edge against the surface 33 of the Yankee drier cylinder. It is observed that three angles are made by the blade with respect to the drier surface: a contact angle a, a grinding angle b, and a cutting or creping angle c. The sum of the three angles is 180°. When a blade having a conventional grinding angle b of 90° is used, the cutting or creping angle c will typically be in the range of 70°–80°, usually approximately 72°, because the contact angle a is generally fixed at a fairly shallow angle by the holder (not shown) for the creping blade. The contact angle is usually small so that the edge at which the blade contacts the surface does not wear away unduly rapidly and so that uniform contact pressure of the blade against the surface can be maintained.

Figure 3:
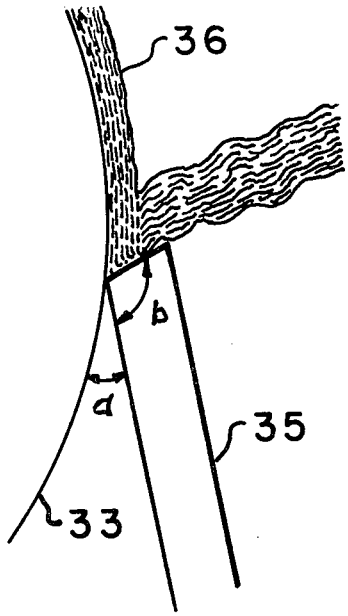
FIG. 3 is a view of a creping blade having a reverse angle meeting the surface of a creping cylinder, and illustrates the action of the creping blade on the web.
Figure 4:
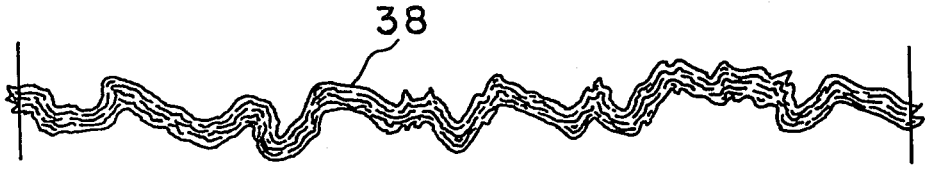
FIG. 4 is an illustrative cross-sectional view of a fibrous paper web formed in accordance with the invention.

The creping angle c can be reduced, however, by increasing the grinding angle b beyond 90°, thereby providing a "reverse angle" creping blade as shown at 35 in FIG. 3. The action of the reverse angle blade on a web 36 on the surface 33 of the drier cylinder is illustrated in this view. As the web 36 comes into contact with the blade, the fibers of the web must radically change direction as they are jammed into the blade, thereby breaking the interfiber bonds that have developed as the web dried on the cylinder surface. A reverse angle blade cannot be used where the web 36 is relatively strong, that is, where its cohesion is greater than the adhesion of the web to the surface. Under such conditions, the fibers of the web do not split apart easily but may rather cause the web 36 to bunch up and be pushed away from the surface 33 rather than be creped. However, when, as in the present invention, the initial bonds between fibers in the web are inhibited by the use of chemical debonders, and the adhesion of the web to the surface is increased by the use of adhesives, creping with a reverse blade will take place because the fibers at the top of the web readily break apart from the fibers at the bottom of the web as they contact the face of the blade. The vigorous mechanical fracturing of the fiber-to-fiber bonds that takes place at the reverse angle blade causes the fibers in the creped web to be widely dispersed, resulting in the creped structure shown in FIG. 3 which is essentially a layered structure having a mat of fibers at the surfaces and a thinner density of fibers in between. This laminar structure not only is highly bulked, but also has great absorbency characteristics since it allows liquids to be held in the relatively large interstices between the low density fibers in the middle of the creped web. An illustrative view of a cross-section of the creped product is shown at 38 in FIG. 4.

The chemical debonding agent added to the pulp furnish adversely effects the adhesion obtainable between the web and the surface of the Yankee drier 23. Thus, greater concentrations of debonding agent in the pulp furnish require correspondingly greater levels of application of adhesive by the sprayer 26 in order to achieve sufficient adhesion of the web to the drier surface to yield the desired creping condition, i.e., internal cohesion of the web less than its adhesion to the drier surface. An upper limit on the amount of debonding agent that can be added to the furnish is imposed because, ultimately, the amounts of adhesive on the Yankee drier surface to obtain adequate adhesion cannot be adequately removed by the creping blade, and the web itself becomes overloaded with adhesive. It is thus preferred that only the minimum amount of adhesive necessary to achieve the desired process conditions be applied to the Yankee drier surface.

Figure 5:
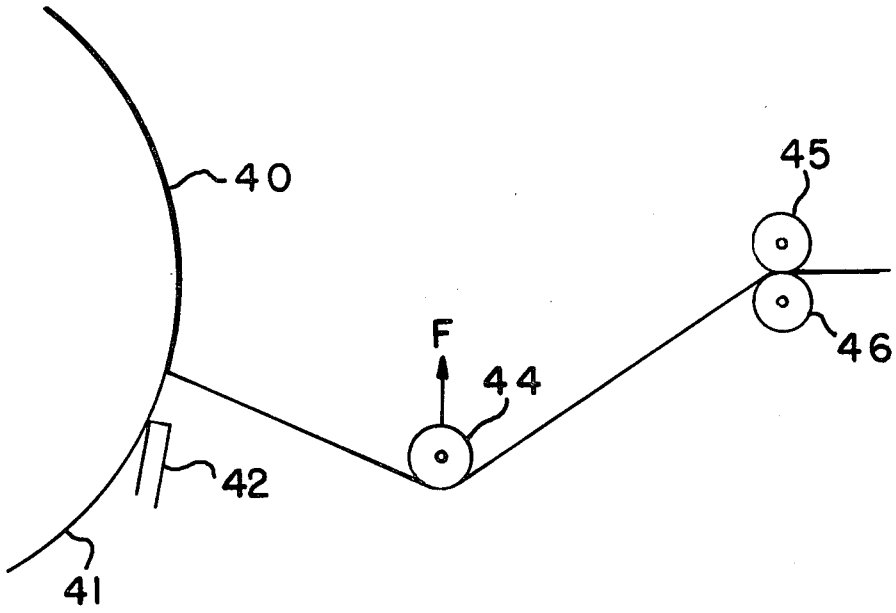
FIG. 5 is a simplified schematic view of apparatus for measuring the adhesion of the dried paper web to the surface of the creping cylinder.

The relative level of adhesion of the web to the Yankee drier surface can be measured directly and dynamically with the apparatus illustrated in FIG. 5. A web 40 is pulled off of the Yankee drier surface 41 ahead of a creping blade 42 and is passed under a tensioning roller 44 up to a nip formed between two calender rollers 45 and 46. The tensioning roller 44 is mounted so as to record the force that the web 40 exerts upwardly on the roller. This force reading can then be related to the tension or force applied along the web at the 90° line of pull. For example, with a pull angle of 90°, an angle between the web moving toward the roller 44 and horizontal of 52°, and an angle between the web away from the roller 44 and horizontal of 34°, the total tension T in the web between the roller 44 and the line at which the web is pulled off of the drier surface is given by the expression $T=0.74\times F$. This force reading is measured on a dynamic basis as the web is being pulled continuously from the surface, and the force per unit width of web can be simply calculated by dividing the web width into the total tension on the web.

Figure 6:
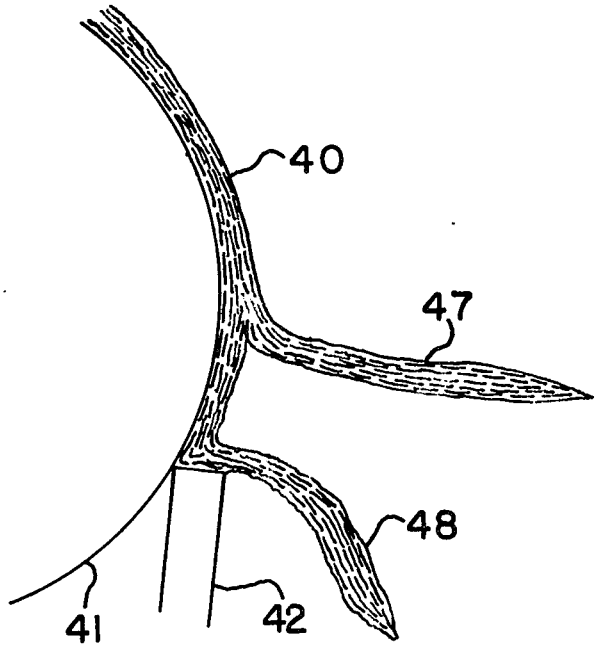
FIG. 6 is an illustrative view of a paper web being pulled from the surface of the creeping cylinder shown in FIG. 5 wherein the web has low internal cohesion.

The level of adhesion can be increased dynamically by increasing the rate at which adhesive is sprayed on the surface of the Yankee drier. Because the web has a weaker than normal internal cohesion, a level of adhesion of the web to the drier surface is eventually reached such that the web 40 splits apart. This condition is illustrated in FIG. 6, which shows a portion 47 of the web splitting away from the underlying fibers of the web that are strongly adhered to the Yankee surface and that eventually form a portion 48 of the web which is creped off the surface by the creping blade 42. At this level of adhesion, the condition for enhanced creping of the web is satisfied. The tensioning roller 44 may then be removed and webs may be run on the equipment under the same process conditions to produce a creped product having exceptional bulk and absorbency as described above. It is noted that the level of adhesion required to achieve the desired creping condition is also affected by the web basis weight and the relative rate at which the creped web is pulled from the creping surface—i.e., the precent crepe. However, these conditions are readily adjusted and are not critical.

The relation between the process conditions required to achieve the product of the invention are described in the examples below. To illustrate the superior qualities of webs formed in accordance with the present process, oil holding tests were performed on these webs and compared with similar tests run on standard substrates. The oil holding test is based on a water holding capacity test developed by J. A. Van den Akker, which has been submitted to the American Society for Testing Materials for certification. The oil holding capacity test utilizes a synthetic oil rather than water but is otherwise similar in procedure to the water holding test. It has been observed that the fibers in the web do not swell in the oil as they do in water. Thus, the oil holding test results reflect the essential "bulk" of the web in its original unswollen dry state, which in turn is related to such product properties as roll diameter and softness; of course, the oil holding test also measures oil absorbency. The water holding test is a direct measure of the ability of a product to absorb and retain water.

The water holding capacity test is difficult to perform on a web produced in accordance with the invention because the water in which the web is soaked tends to destroy the hydrogen bonds between fibers; when lifted from the soaking water, the web falls apart. However, hydrogen bonding between fibers is not substantially affected by oil, and webs soaked in oil usually will hold together when removed from the oil in which the webs are soaked. The oil holding test can indirectly be used to measure water holding capacity on such webs: in experiments on other paper webs strong enough to hold up to the water capacity test, an increase in oil holding capacity from one web to another was directly correlated to an increase in water holding capacity. For example, as measured by the test procedure described below, a web having an oil holding capacity ratio of 7 was found to have a water holding capacity ratio of 10, whereas a web of the same base fibers having an oil holding capacity ratio of 10 had a water holding capacity ratio of 13.5.

The water holding capacity test may be briefly summarized as follows. At least five specimens, three inches by three inches on a side, are cut from the finished web. Each specimen is weighed and the weight (or mass in grams) recorded by itself and while on a metal specimen catcher plate. Each specimen is then laid upon back up foamed plastic with the side to be laid in contact with the water facing up, and a row of hooks on a specimen holder is pushed through the specimen as it is supported on the foamed plastic. The specimen holder and specimen are then inverted and the specimen is laid on water held in a dish. A stop watch is started at the moment that the specimen contacts the water. After 59 seconds, the specimen is lifted from the water and laid on an excess water extractor formed of an aluminum plate with a series of slots milled in it to allow excess water to drain out. The elevation of the top surface of the excess water extractor above the pool of water is maintained at 5 mm, so that the specimen is subjected to a suction head of 5 mm of water. The specimen is left on the excess water extractor plate for 15 seconds, is then lifted out and placed on the specimen catcher, the specimen holder is removed and the combination of the specimen catcher and wet specimen is weighed and the weight recorded. The other specimens are tested in the same manner, and another series of specimens may be tested to determine the water holding capacity of the other side of the web. The dry and wet specimen weights in grams are calculated by substracting the known weight of the specimen catcher from the combined weights, calculating the dry basis weight of the specimens in grams per square meter, and calculating the amount of water held by the specimen, in grams, by substracting the dry specimen weight from the wet specimen weight. The water holding capacity is then calculated as the number of grams of water held per square meter by multiplying the water held by the specimen by 172. The water holding capacity ratio is the ratio of the weight of the water held to the dry specimen weight.

The above procedure can be modified to determine oil holding capacity, with dimethyl polysiloxane being the oil preferred for use in this test. It is performed in a manner similar to that described above for the water holding test with a few modifications. In the oil holding capacity test, the extractor comprises an aluminum plate having 0.79 mm wide slots milled into it, which are narrower than the 1.6 mm slots milled in the excess water extractor for use in the water holding test. When oil is used instead of water, the specimen is not totally immersed at the beginning of the contact period but it is just laid into contact with the oil. The specimen, after pick up of the oil, is laid on the excess oil extractor for a period of thirty seconds, and the weight is then measured as described above. The ratio of oil weight to dry fiber weight is divided by the oil density (0.934 grams/milliliter) to yield the oil holding capacity ratio in milliliters of oil per gram of fiber.

EXAMPLE 1

A highly bulked paper web was made in accordance with the invention using a furnish which consisted of 70% Ontario softwood krafts and 30% Ontario hardwood kraft. The furnish was very lightly refined at about 3% consistency to insure good fiber dispersion, and the freeness of the refined stock as 620 by the Canadian Standard Freeness Method. The 3% stock was transferred from a stock tank and diluted to a consistency of about 0.6%, and the pH was adjusted to about 6.5. A quaternized imidazoline debonding agent, Quaker 2006, was added to the stock furnish in an amount equal to about 0.5% by weight of the dry fiber, or a concentration of about 30 ppm on the total furnish.

Processing of the furnish into a creped web was carried out on conventional felted wet press papermaking equipment. The fiber furnish was formed into a web on a Fourdrinier wire to a consistency of about 20% to 24% pulp fiber; the web was transferred off of the wire to a felt which delivered the web to the Yankee drier where it was pressed against the surface of the drier such that the consistency of the web was increased to about 35% pulp fiber. The web was dried on the heated Yankee surface to a consistency of about 95%, creped off of the drier surface, passed through a light calender nip, and wound up on a reel. The surface speed of the web at the reel was 20% less than that of the speed of the surface of the Yankee drier to give the reeled web a net crepe of 20%—that is, the ratio of the difference in speed between the Yankee drier surface and reel speed over the speed of the Yankee drier. The surface speed at the calender nip was 25% less than that of the Yankee drier surface.

The adhesion of the web to the Yankee drier surface was such that an appreciable amount of delamination of the web took place when the web was pulled off of the Yankee without creping. The tension on the web when delamination occurred was measured, in the fashion described above and illustrated in FIG. 5, to be about 5.5 grams per centimeter width of the web. This condition of web adhesion to the Yankee drier surface was obtained by spraying a 0.001% solids solution of Cynamid Parez NC631 wet strength resin (polyacrylamide) on the Yankee drier surface just adhead of the pressure roll nip at a volumetric flow rate in the range of 2 to 4 gallons per ream (3,000 ft.$^2$) of the web being transferred to the Yankee drier surface.

A reverse angle creping blade was used which had the front face thereof beveled at a 20% angle and inserted in the blade holder to provide a creping or cutting angle of about 52°.

The resulting web substrate had the following properties:

Basis weight—14.5 lbs/ream (3,000 ft.$^2$)
Caliper of 8 plys—1.27 mm.
Tensile strength
machine direction (MD)
43.18 g/cm
cross direction (CD)
23.5 g/cm
Percentage stretch
MD 16.3%
CD 3.5%
Oil Holding Capacity Ratio (OHC)—9.2 ml/g.

The caliper of the eight stacked plys was measured using a two inch diameter anvil and a dead load of 539 grams, yielding a compressive pressure of 26.6 grams/-square centimeter.

It is noted that an oil holding capacity ratio of about 7 or less is ordinarily achieved with standard substrates made on the same type of equipment as described above with no addition of chemical debonders and standard creping conditions. Such standard substrates are found to have a water holding capacity ratio ranging from about 8 to 9, which is typical of commercial paper toweling made by the conventional wet press method. The expected water holding capacity of the towel described above, based on the measured oil holding capacity ratio, is comparable to products made by high energy consuming processes involving through air drying, which are found to have typical water holding capacities in the range of 13 to 17.

EXAMPLE 2

Other substrates were produced using the same furnish, debonder, and Yankee drier adhesive as described above but varying the concentration of debonder in the furnish, the adhesion of the web to the Yankee drier cylinder, and the angle of the creping blade. The conditions of the runs and the characteristics of the substrates produced are given below in the table. For each run, the percent of creping was 25% at the calender rollers and 20% at the windup reel.

| Run No. | Debonder Added % | Web Adhesion g/cm | Creping Angle | Basis Weight lbs/rm | Tensile Strength g/cm MD | Tensile Strength g/cm CD | Caliper 8 Plys mm | Oil Holding Capacity ml/g |
|---|---|---|---|---|---|---|---|---|
| 1 | 0.0 | 17.7 | 72° | 15.64 | 248 | 90 | 1.17 | 7.23 |
| 2 | 0.2 | 11.4 | 72° | 15.37 | 209 | 66 | 1.12 | 6.60 |
| 3 | 0.4 | 7.1 | 72° | 15.18 | 103 | 43 | 1.17 | 7.11 |
| 4 | 0.5 | 5.9 | 72° | 15.05 | 78 | 27 | 1.21 | 8.03 |
| 5 | 0.6 | 4.7 | 72° | 14.94 | 64 | 23 | 1.17 | 7.77 |
| 6 | 0.7 | 4.7 | 72° | 14.80 | 52 | 16 | 1.27 | 8.08 |
| 7 | 0.8 | 4.3 | 72° | 14.98 | 41 | 19 | 1.25 | 9.63 |
| 8 | 0.5 | 2.0 | 72° | 14.18 | 85 | 24 | 1.19 | 7.17 |
| 9 | 0.5 | 4.7 | 72° | 14.50 | 52 | 16 | 1.15 | 7.56 |
| 10 | 0.5 | 9.8 | 72° | 15.35 | 59 | 18 | 1.18 | 8.23 |
| 11 | 0.5 | 1.6 | 64° | 13.77 | 87 | 26 | 1.30 | 7.92 |
| 12 | 0.5 | 4.7 | 64° | 14.83 | 52 | 17 | 1.21 | 8.54 |
| 13 | 0.5 | 9.8 | 64° | 15.42 | 47 | 15 | 1.26 | 9.53 |
| 14 | 0.5 | 1.6 | 52° | 13.77 | 66 | 19 | 1.35 | 9.71 |
| 15 | 0.5 | 4.3 | 52° | 16.10 | 45 | 16 | 1.37 | 9.75 |
| 16 | 0.5 | 9.8 | 52° | 15.40 | 34 | 12 | 1.30 | 11.53 |

The first three runs summarized in the table above were operated under conditions of debonder addition and web adhesion which did not result in greater adhesion of the web to the drier cylinder than the internal cohesion of the web, because of the relatively low levels of debonding agent in the fiber furnish. As the level of the debonder was increased while at least medium levels of web adhesion to the Yankee cylinder were maintained, substantially improved results in oil holding capacity were obtained, as shown in runs 4–7.

Runs 8–16 illustrate the effect of changes in web adhesion and changes in the angle of the creping blade while the amount of debonding agent is held constant at a 0.5% level based on the dry fiber in the fiber furnish. It is observed from these tests that substantial improvement in the oil holding capacity of the creped web is obtained even at low web adhesion levels with the use of a 52° cutting angle creping blade. At each blade angle, an increase in web adhesion results in a corresponding increase in the oil holding capacity of the web.

EXAMPLE 3

Substrate webs can be produced by the process of the invention at basis weights up to 30 to 40 pounds per ream if desired. Webs produced by standard processes generally have a lower oil and water holding capacity ratio at such high basis weights than they do at basis weights in the 15 pound per ream range. At 30 pounds per ream, oil holding capacity ratios of about 5 are typical.

Four webs having basis weights in the 30 pound-/ream range were produced in accordance with the invention using the same furnish, debonder, and Yankee drier adhesive as in Example 1. The debonder was added in an amount constituting 0.75% of the dry weight of the fiber furnish and the creping adhesive (Parez NC631, 0.006 to 0.01% solids) was applied to the drier cylinder at a level sufficient to maintain about 7.5 grams/centimeter adhesion between the web and the creping surface. For each run, the percent of creping was 25% at the calender rollers and 20% at the windup reel. The characteristics of the four webs are listed in the table below.

| Run No. | Creping Angle | Basis Weight lbs/rm | Tensile Strength g/cm MD | Tensile Strength g/cm CD | Caliper 8 plys mm | Oil Holding Capacity ml/g |
|---|---|---|---|---|---|---|
| 1 | 72° | 31.18 | 154 | 46 | 2.38 | 5.90 |
| 2 | 64° | 31.04 | 103 | 34 | 2.37 | 6.86 |
| 3 | 58° | 30.39 | 75 | 28 | 2.25 | 7.49 |
| 4 | 52° | 29.89 | 66 | 27 | 2.01 | 8.68 |

The web characteristics summarized above illustrate the substantial improvement in oil holding capacity which occurs as the creping angle is reduced, provided that satisfactory conditions of web cohesion and adhesion to the drier surface are maintained.

It is understood that the invention is not confined to the particular embodiments disclosed herein as illustrative of the invention, but embraces such modified forms thereof as come within the scope of the following claims.

What is claimed is:

1. A process for producing paper webs having exceptional bulk and absorbency, comprising the steps of:
   (a) mixing a predetermined amount of chemical debonding agent which inhibits the formation of interfiber bonds into a pulp furnish;
   (b) forming the pulp furnish and debonding agent mix into a web;
   (c) pressing the web to reduce the moisture content thereof;
   (d) applying the web to a heated, moving creping surface and drying the web on the creping surface;
   (e) simultaneously uniformly applying a predetermined amount of creping adhesive to the creping surface ahead of the position at which the web is applied to the moving creping surface;
   (f) the amount of debonding agent mixed into the pulp furnish and the amount of creping adhesive applied to the creping surface selected such that substantial splitting apart of the web would occur if the web were pulled from the creping surface; and
   (g) creping the dried web by removing the web from the creping surface with the creping blade having a cutting angle of about 72° or less such that crepes are formed on both sides of the web.

2. The process of claim 1 including, after creping of the web from the creping surface, the steps of calendering the web between a pair of calender rollers and winding the calendered web into a roll.

3. The process of claim 1 wherein the creping blade meets the creping surface at a cutting angle between 64° and 52° inclusive.

4. The process of claim 1 wherein the creping blade meets the creping surface at a cutting angle of approximately 52°.

5. The process of claim 1 wherein the chemical debonding agent is a quaternized imidazoline in an amount not less than 0.5% on the dry weight of the fibers in the pulp furnish.

6. The process of claim 1 wherein the creping adhesive is applied in an amount sufficient to provide at least 4.3 grams per centimeter of adhesion of the web to the creping surface at the creping blade as measured dynamically.

7. The process of claim 1 wherein the creping adhesive is selected from the group consisting of animal glue and wet strength latex.

8. A process for producing paper webs having exceptional bulk and absorbency, comprising the steps of:
   (a) mixing a quaternized imidazoline into a pulp furnish in a predetermined amount not less than 0.5% on the dry weight of the fibers in the pulp furnish;
   (b) forming the pulp furnish and quaternized imidazoline mix into a web;
   (c) pressing the web to reduce the moisture content thereof;
   (d) applying the web to a heated, moving creping surface and drying the web on the creping surface;
   (e) creping the dried web by removing the dried web from the creping surface with a creping blade which meets the creping surface at a cutting angle of approximately 52°;
   (f) simultaneously uniformly applying creping adhesive to the creping surface ahead of the position at which the web is applied to the moving creping surface in a predetermined amount sufficient to provide at least 1.6 grams per centimeter adhesion of the web to the creping surface at the creping blade as measured dynamically and such that crepes are formed on both sides of the web, the amounts of quaternized imidazoline and creping adhesive selected such that substantial splitting of the web would occur if the web were pulled from the creping surface.

9. A process for producing paper webs having exceptional bulk and absorbency, comprising the steps of:
   (a) mixing a chemical debonding agent which inhibits the formation of interfiber bonds into a pulp furnish;
   (b) forming the pulp furnish and debonding agent mix into a web;
   (c) pressing the web to reduce the moisture content thereof;
   (d) applying the web to a heated, moving creping surface and drying the web on the creping surface;
   (e) simultaneously uniformly applying creping adhesive to the creping surface ahead of the position at which the web is applied to the moving creping surface;
   (f) pulling the web from the creping surface;
   (g) increasing the amount of creping adhesive applied to the creping surface until reaching a selected amount such that the web splits apart as it is pulled from the creping surface, and thereafter applying the selected amount of adhesive to the creping surface;

(h) then, ceasing pulling the web from the creping surface; and (i) creping the dried web by removing the web from the creping surface with a creping blade having a cutting angle of about 72° or less such that crepes are formed on both sides of the web.

10. A process for producing paper webs having exceptional bulk and absorbency, comprising the steps of:

(a) mixing a predetermined amount of quaternized imidazoline debonding agent which inhibits the formation of interfiber bonds into a pulp furnish in an amount not less than 0.5% on the dry weight of the fiber in the pulp furnish;

(b) forming the pulp furnish and debonding agent mix into a web;

(c) pressing the web to reduce the moisture content thereof;

(d) applying the web to a heated, moving creping surface and drying the web on the creping surface;

(e) creping the dried web by removing the web from the creping surface with a creping blade having a cutting angle between 52° and 64° inclusive; and (f) simultaneously uniformly applying a predetermined amount of creping adhesive to the creping surface ahead of the position at which the web is applied to the moving creping surface in an amount sufficient to provide at least 4.3 grams per centimeter of adhesion of the web to the creping surface at the creping blade as measured dynamically and such that crepes are formed on both sides of the web, the amounts of debonding agent and creping adhesive selected such that substantial splitting of the web would occur if the web were pulled from the creping surface.

11. A process for producing paper webs having exceptional bulk and absorbency, comprising the steps of:

(a) mixing a predetermined amount of quaternized imidazoline debonding agent which inhibits the formation of interfiber bonds into a pulp furnish in an amount not less than 0.5% on the dry weight of the fibers in the pulp furnish;

(b) forming the pulp furnish and debonding agent mix into a web;

(c) pressing the web to reduce the moisture content thereof;

(d) applying the web to a heated, moving creping surface and drying the web on the creping surface;

(e) creping the dried web by removing the web from the creping surface with a creping blade having a cutting angle between 52° and 72° inclusive; and (f) simultaneously uniformly applying a predetermined amount of creping adhesive to the creping surface ahead of the position at which the web is applied to the moving creping surface in an amount sufficient to provide at least 5.9 grams per centimeter of adhesion of the web to the creping surface at the creping blade as measured dynamically and such that crepes are formed on both sides of the web, the amounts of debonding agent and creping adhesive selected such that substantial splitting of the web would occur if the web were pulled from the creping surface.

* * * * *

UNITED STATES PATENT AND TRADEMARK OFFICE

CERTIFICATE OF CORRECTION

PATENT NO. : 4,448,638

DATED : May 15, 1984

INVENTOR(S) : Bernard G. Klowak

It is certified that error appears in the above-identified patent and that said Letters Patent are hereby corrected as shown below:

Column 2, line 46, the first "is" should read --if--.

Column 3, line 62, "creeping" should read --creping--.

Column 10, in the table, under the heading Oil Holding Capacity, "6.60" should read --6.63--.

Column 11, in the table, under the heading Tensile Strength g/cm, MD, "154" should read --134--.

Signed and Sealed this

*Eighteenth* Day of *September 1984*

[SEAL]

*Attest:*

GERALD J. MOSSINGHOFF

*Attesting Officer*

*Commissioner of Patents and Trademarks*